US010285899B2

(12) United States Patent
Jones

(10) Patent No.: US 10,285,899 B2
(45) Date of Patent: May 14, 2019

(54) EXERCISE DEVICE

(71) Applicant: COULTER VENTURES LLC, Columbus, OH (US)

(72) Inventor: Dylan Jones, Columbus, OH (US)

(73) Assignee: COULTER VENTURES LLC, Columbus, OH (US)

( * ) Notice: Subject to any disclaimer, the term of this patent is extended or adjusted under 35 U.S.C. 154(b) by 338 days.

(21) Appl. No.: 15/365,236

(22) Filed: Nov. 30, 2016

(65) Prior Publication Data

US 2017/0079873 A1 Mar. 23, 2017

Related U.S. Application Data

(63) Continuation-in-part of application No. 14/275,622, filed on May 12, 2014, now Pat. No. 9,616,279.
(Continued)

(51) Int. Cl.
*A61H 15/00* (2006.01)
*A63B 21/00* (2006.01)
(Continued)

(52) U.S. Cl.
CPC ..... *A61H 15/00* (2013.01); *A63B 21/0004* (2013.01); *A63B 21/068* (2013.01); *A63B 23/0216* (2013.01); *A61H 2015/0042* (2013.01); *A61H 2201/0192* (2013.01); *A61H 2201/1261* (2013.01); *A61H 2201/1284* (2013.01); *A61H 2201/164* (2013.01); *A61H 2201/1623* (2013.01); *A61H 2201/1685* (2013.01); *A61H 2201/1695* (2013.01); *A63B 21/0023* (2013.01); *A63B 21/0607* (2013.01); *A63B 23/1209* (2013.01); *A63B 43/00* (2013.01);
(Continued)

(58) Field of Classification Search
CPC . A63B 21/0004; A63B 22/0046; A63B 22/18; A63B 26/003; A63B 2023/006; A63B 41/08; A63B 41/085; A63B 43/00; A63B 45/00; A63B 43/002; A63B 43/04; A61H 1/008; A61H 2201/1284; A61H 2201/1623; A61H 2201/1695; A61H 2201/1685; A61H 2201/0161; A61H 2201/0167; A61H 2201/0107; A61H 2201/01; A61H 15/00; A61H 15/0092; A61H 2015/0007; A61H 2015/0014; A61H 2015/0021; A61H 2015/0042; A61H 2015/005; A61H 2015/0057; A61H 2015/0064; A61H 2015/0071; A61H 2205/081; A61H 2203/0456; A61H 7/001; A63F 2009/124
USPC ..... 482/132; D21/478
See application file for complete search history.

(56) References Cited

U.S. PATENT DOCUMENTS 2,495,079 A * 1/1950 Sonnett ..... A63B 41/08 473/597
3,008,719 A * 11/1961 Misko ..... A63F 7/00 273/113
(Continued)

OTHER PUBLICATIONS

Sep. 22, 2014 Extended Search Report issued in European Patent Application No. 14168045.4.

*Primary Examiner* — Joshua Lee
(74) *Attorney, Agent, or Firm* — Vorys, Sater, Seymour and Pease LLP; William L. Klima

(57) ABSTRACT

A exercise device, for example, and exercise ball device. The exercise device includes a frame and at least one panel or multiple panels.

19 Claims, 15 Drawing Sheets

Related U.S. Application Data

(60) Provisional application No. 61/822,678, filed on May 13, 2013.

(51) Int. Cl.

| | |
|---|---|
| ***A63B 23/02*** | (2006.01) |
| ***A63B 21/068*** | (2006.01) |
| *A63B 21/06* | (2006.01) |
| *A63B 23/12* | (2006.01) |
| *A63B 43/00* | (2006.01) |
| *A63B 45/00* | (2006.01) |
| *A63B 21/002* | (2006.01) |

(52) U.S. Cl.

CPC ..... *A63B 45/00* (2013.01); *A63B 2209/02* (2013.01); *A63B 2209/10* (2013.01); *A63B 2225/09* (2013.01)

(56) References Cited

U.S. PATENT DOCUMENTS 3,508,750 A * 4/1970 Henderson ..... A63B 39/00 473/605
3,863,923 A 2/1975 Anderson
4,050,184 A 9/1977 Chiari
5,236,196 A * 8/1993 Blankenburg ..... G09B 23/04 434/213
5,340,349 A * 8/1994 Berg-Fernstrum ..... A63F 9/12 446/121
5,389,063 A * 2/1995 Wu ..... A61H 7/001 273/153 S
5,577,995 A * 11/1996 Walker ..... A61H 15/0092 601/118
5,816,571 A * 10/1998 Chen ..... A63F 9/0857 273/153 S
5,823,843 A * 10/1998 Pohlman ..... A63H 33/101 446/120
5,931,752 A * 8/1999 Guenther ..... A63B 41/08 473/597
5,984,812 A * 11/1999 Sassak ..... A63B 59/50 473/596
6,302,815 B1 10/2001 Shishido et al.
6,520,877 B1 * 2/2003 Yang ..... A63B 41/08 473/597
6,685,584 B2 * 2/2004 Jin ..... A63B 37/14 473/596
6,769,690 B1 * 8/2004 Khoudary ..... B64G 1/641 273/153 S
6,805,350 B1 * 10/2004 Wu ..... A63B 43/00 273/156
7,155,851 B2 * 1/2007 Ootsuka ..... A47G 1/12 40/600
7,517,324 B2 * 4/2009 Cohen ..... A61H 7/001 601/135
7,740,551 B2 * 6/2010 Nurnberg ..... A63B 41/02 473/570
8,141,876 B2 * 3/2012 Humphreys ..... A63H 33/108 273/156
2003/0045383 A1 * 3/2003 Jiminez ..... A63B 41/08 473/597
2004/0142780 A1 * 7/2004 Estefano ..... A63B 37/14 473/604
2005/0269770 A1 * 12/2005 Mak ..... A63F 9/0838 273/153 R
2006/0089578 A1 * 4/2006 Hsu ..... A61H 15/00 601/118
2007/0037642 A1 * 2/2007 Chang ..... A63B 41/08 473/604
2007/0049434 A1 * 3/2007 Maziarz ..... A63B 41/08 473/604
2007/0225133 A1 * 9/2007 Castro ..... A63B 21/0004 482/140
2009/0325744 A1 * 12/2009 Raynak ..... A63B 41/085 473/604
2009/0325747 A1 * 12/2009 Ou ..... A63B 41/08 473/605
2010/0179593 A1 * 7/2010 Lamar ..... A61J 17/007 606/236
2010/0240479 A1 * 9/2010 Raynak ..... A63B 41/08 473/604
2010/0301558 A1 * 12/2010 Speegle ..... A63F 9/12 273/153 S
2011/0256967 A1 * 10/2011 Shore ..... A63B 43/00 473/595
2012/0258824 A1 * 10/2012 Berggren ..... A63B 41/08 473/604
2012/0329587 A1 * 12/2012 Ou ..... A63B 41/08 473/605
2013/0005521 A1 * 1/2013 White ..... A63B 41/085 473/604
2013/0059683 A1 * 3/2013 Krysiak ..... A63B 41/02 473/597
2013/0139797 A1 * 6/2013 Oblack ..... F41B 3/04 124/5
2014/0274465 A1 * 9/2014 Francis ..... A63B 43/00 473/351

* cited by examiner

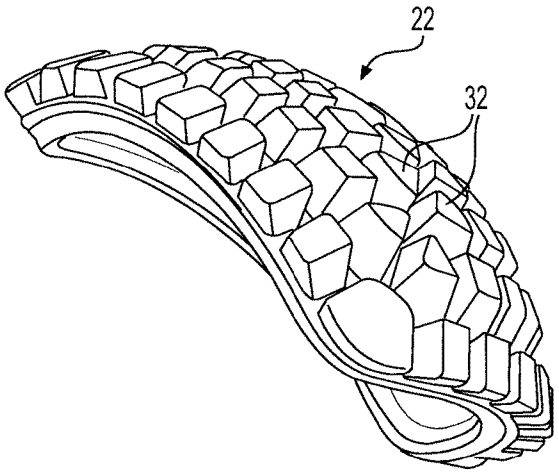
FIG. 11
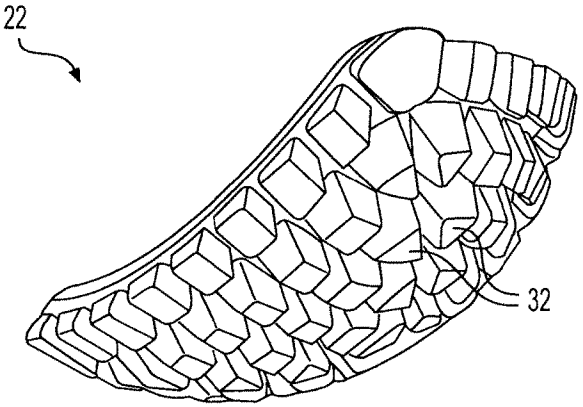
FIG. 10
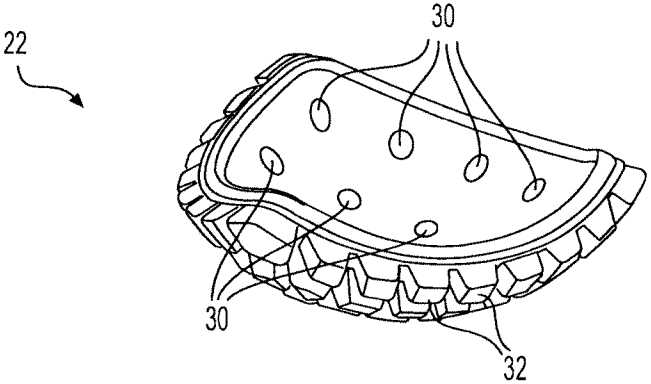

EXERCISE DEVICE

RELATED APPLICATION(S)

This U.S. Patent Application claims priority and the benefits under 35 U.S.C. 119(e) and 120 of U.S. Patent Application entitled "Exercise Device", application Ser. No. 14/275,622, filed on May 12, 2014, and U.S. Provisional Application entitled "Exercise Device", No. 61/822,678, filed on May 13, 2013, the contents of which are hereby incorporated by reference in their entirety.

FIELD

An exercise device, in particular a composite exercise device comprising a frame and at least one panel defining an outer surface of the exercise device. For example, a ball or sphere-shaped exercise device.

BACKGROUND

In the past, various types of balls are used as exercise balls. The exercise balls are typically deformable and filled with air. A person can exercise using the exercise ball in many different ways.

SUMMARY

An improved exercise device.

An improved exercise ball device.

A composite exercise device.

A composite exercise ball device.

An exercise device comprising or consisting of a frame supporting at least one panel.

An exercise ball device comprising or consisting of a frame supporting at least one panel.

An exercise device comprising or consisting of a three dimensional space frame supporting at least one panel.

An exercise ball device comprising or consisting of a three dimensional space frame supporting at least one panel.

An exercise device comprising or consisting of a frame supporting multiple panels.

An exercise ball device comprising or consisting of a frame supporting multiple panels.

An exercise device comprising or consisting of a frame supporting multiple same size and shape panels.

An exercise ball device comprising or consisting of a frame supporting multiple same size and shape panels.

An exercise device comprising or consisting of a substantially rigid frame supporting multiple resiliently deformable panels.

An exercise ball device comprising or consisting of a substantially rigid frame supporting multiple resiliently deformable panels.

An exercise device comprising or consisting of a substantially rigid frame comprising multiple frame members connected together supporting multiple resiliently deformable panels.

An exercise ball device comprising or consisting of a substantially rigid frame comprising multiple frame members connected together supporting multiple resiliently deformable panels.

An exercise device comprising or consisting of a substantially rigid frame comprising multiple frame members connected together at one or more nodes supporting multiple resiliently deformable panels.

An exercise ball device comprising or consisting of a substantially rigid frame comprising multiple frame members connected together at one or more nodes supporting multiple resiliently deformable panels.

An exercise device comprising or consisting of a substantially rigid frame comprising multiple frame members connected together at one or more nodes and one or more cross members, the substantially rigid frame supporting multiple resiliently deformable panels.

An exercise ball device comprising or consisting of a substantially rigid frame comprising multiple frame members connected together at one or more nodes and one or more cross members, the substantially rigid frame supporting multiple resiliently deformable panels.

An exercise device comprising or consisting of a substantially rigid frame defining at least one opening, the rigid frame comprising a flange surrounding at least a portion of the opening for supporting a resiliently deformable panel.

An exercise ball device comprising or consisting of a substantially rigid frame defining at least one opening, the rigid frame comprising a flange surrounding at least a portion of the opening for supporting a resiliently deformable panel.

An exercise device comprising or consisting of a substantially rigid frame defining at least one opening, the rigid frame comprising a flange surrounding the opening for supporting a resiliently deformable panel.

An exercise ball device comprising or consisting of a substantially rigid frame defining at least one opening, the rigid frame comprising a flange surrounding the opening for supporting a resiliently deformable panel.

A method of making an exercise device, comprising or consisting of providing a frame, and connecting one or more panels to the frame.

A method of making an exercise ball device, comprising or consisting of providing a frame, and connecting one or more panels to the frame.

A method of making an exercise device, comprising or consisting of providing a frame, and connecting one or more resilient panels to the frame.

A method of making an exercise ball device, comprising or consisting of providing a frame, and connecting one or more resilient panels to the frame.

A method of making an exercise device, comprising or consisting of molding a frame, and connecting one or more panels to the frame.

A method of making an exercise ball device, comprising or consisting of molding a frame, and connecting one or more panels to the frame.

A method of making an exercise device, comprising or consisting of molding a frame, molding one or more panels each comprising two or more layers; and connecting the one or more panels to the frame.

A method of making an exercise ball device, comprising or consisting of molding a frame, molding one or more panels each comprising two or more layers; and connecting one or more panels to the frame.

A method of making an exercise device, comprising or consisting of molding a frame, insert molding one or more panels each comprising two or more layers; and connecting the one or more panels to the frame.

A method of making an exercise ball device, comprising or consisting of molding a frame, insert molding one or more panels each comprising two or more layers; and connecting one or more panels to the frame.

A method of making an exercise device, comprising or consisting of molding a frame, insert molding one or more panels each comprising multiple layers; and connecting the one or more panels to the frame.

A method of making an exercise ball device, comprising or consisting of molding a frame, insert molding one or more panels each comprising multiple layers; and connecting one or more panels to the frame.

A method of making an exercise device, comprising or consisting of molding a frame, molding one or more panels each comprising an inner layer; overmolding an outer layer over the inner layer of each panel; and connecting the one or more panels to the frame.

A method of making an exercise ball device, comprising or consisting of molding a frame, molding one or more panels each comprising an inner layer; overmolding an outer layer over the inner layer of each panel; and connecting one or more panels to the frame.

A method of making an exercise device, comprising or consisting of molding a frame, molding one or more panels each comprising an inner layer; overmolding a softer outer layer over the inner layer of each panel; and connecting the one or more panels to the frame.

A method of making an exercise ball device, comprising or consisting of molding a frame, molding one or more panels each comprising an inner layer; overmolding a softer outer layer over the inner layer of each panel; and connecting one or more panels to the frame.

A method of making an exercise device, comprising or consisting of injection molding a frame, injection molding one or more panels each comprising an inner layer; overmolding an outer layer over the inner layer of each panel; and connecting the one or more panels to the frame.

A method of making an exercise ball device, comprising or consisting of injection molding a frame, molding one or more panels each comprising an inner layer; overmolding an outer layer over the inner layer of each panel; and connecting one or more panels to the frame.

An exercise device comprising or consisting of a frame and at least one panel. For example, the exercise device is an exercise ball device. Further, for example, the exercise device comprises or consists of a frame and multiple panels. The panels can be of the same size and shape, or can be of different size and/or shape. The shape of the exercise device can be spherical-shaped (i.e. ball shaped), or can be other shapes (e.g. pyramid, cube, cylindrical, octahedron, torus, etc.). Further, the panels can comprise or be made of multiple layers, for example, a stiffer inner layer supporting a softer or more resilient outer layer. The outer layer can be overmolded on the inner layer.

The frame, for example, can be a substantially rigid frame. The frame, for example, can comprise multiple frame members connected together. For example, the multiple frame members are connected together at nodes. Further, one or more cross-members can connect frame members together to further increase the rigidity of the frame. For example, the frame is a three (3) dimensional space frame the same or similar in shape to a sphere or ball. As a further, example, the outer frame members are curved and connect together at nodes, and one or more cross-members connect opposed outer frame members through an inner space defined by the outer curved frame members.

The frame can be molded, extruded, and/or machined (e.g. injection molded) as a single piece, or separate frame members can be made and then connected or assembled together. The frame can be made of plastic (e.g. nylon, polyethylene, polypropylene, ABS, or other suitable plastic), plastic material (e.g. plastic composition or material), composite material (e.g. fiberglass, carbon fiber, Kevlar, boron fiber), metal (e.g. aluminum, titanium, metal composite), or other suitable structural material. Again, the frame can have a one piece construction (e.g. molded, extruded, formed, or machined from a pre-form or block of material), or a multiple piece construction where the pieces of the frame are made and then connected or assembled together.

The frame can be configured to define one or more openings. For example, the frame comprises multiple openings (e.g. same size and shaped openings symmetrically spaced about the frame, e.g. four (4) openings). The frame can support one or more panels. The one or more panels can be connected (e.g. mechanically fastened, thermally connected, molded, overmolded, using adhesive, or combination thereof) to secured or anchor the one or more panels to the frame.

The frame can comprise a flange surrounding at least a portion of the perimeter of each opening, or the entire perimeter of each opening. The flange can connect with and structurally support the edges of the one or more panels when the panels are assembled onto the frame.

The panels can be each be made as a single piece construction, or can be made of multiple pieces joined together (e.g. molded, overmolded, layered, adhered, mechanically coupled, or combination thereof). For example, the panels can each be made with an inner support panel (e.g. made of nylon and stiffer than outer cover panel) and an outer cover panel made of resilient deformable material (e.g. soft and/or resilient plastic or thermoplastic elastomer). The outer panels can be smooth or textured (e.g. provided with textured pattern, projections, indents, spikes, grooves, different surface textures).

The panels can be made with an inner support panel (i.e. inner layer of panel) comprising a plurality of through holes (e.g. a distributed pattern of through holes) so that when the outer cover panel (i.e. outer layer of panel) is molded or overmolded thereto, the hot plastic material flows and enters the through holes, and then hardens to form a plurality of mechanical anchors. The through holes can be beveled or chamfered (e.g. on inner side of inner support panel) to create mechanical anchors when material from overmolding the outer cover panel flows, enters, and sets in the beveled or chamfered through hole portion providing even a greater retaining strength due to the beveled or chamfered configuration of the through holes.

BRIEF DESCRIPTION OF DRAWINGS

FIG. 10 is a perspective view of one (1) panel of the exercise ball device shown in FIGS. 1 and 8.

FIG. 11 is another perspective view of the panel shown in FIG. 10.

DETAILED DESCRIPTION

Figure 1:
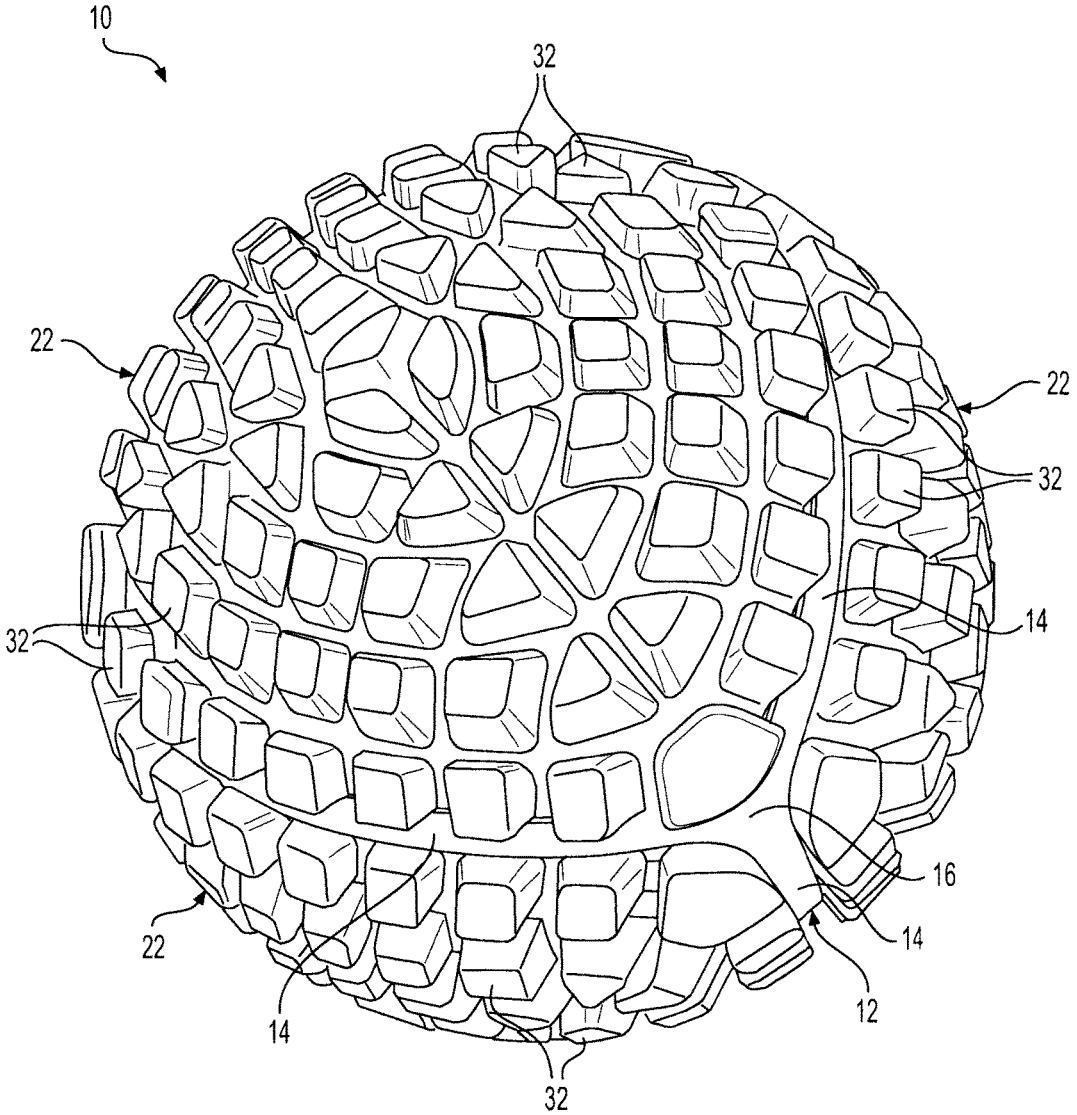
FIG. 1 is a perspective view of an exercise ball device.
Figure 2:
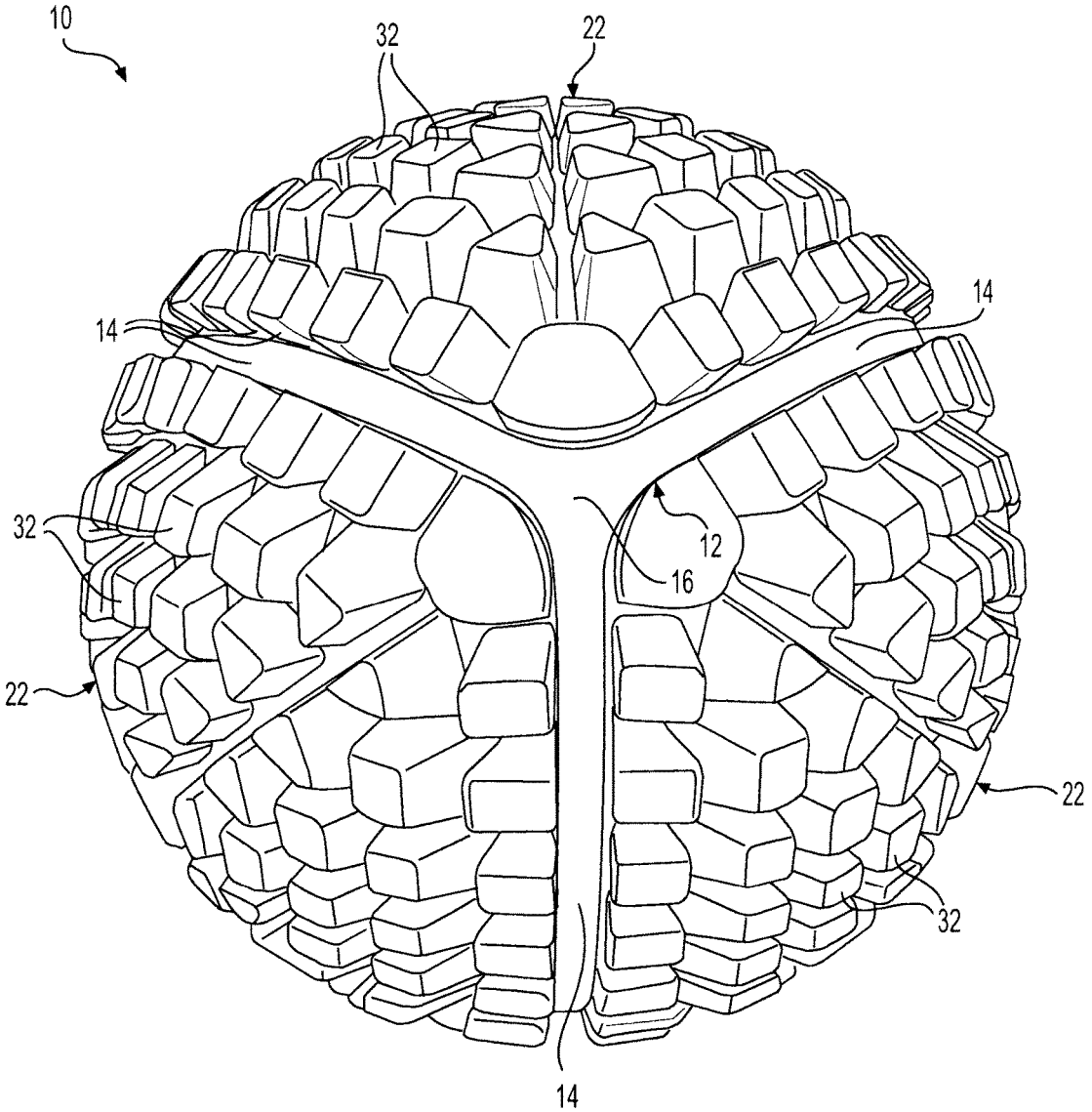
FIG. 2 is a front elevational view of the exercise ball device shown in FIG. 1.
Figure 3:
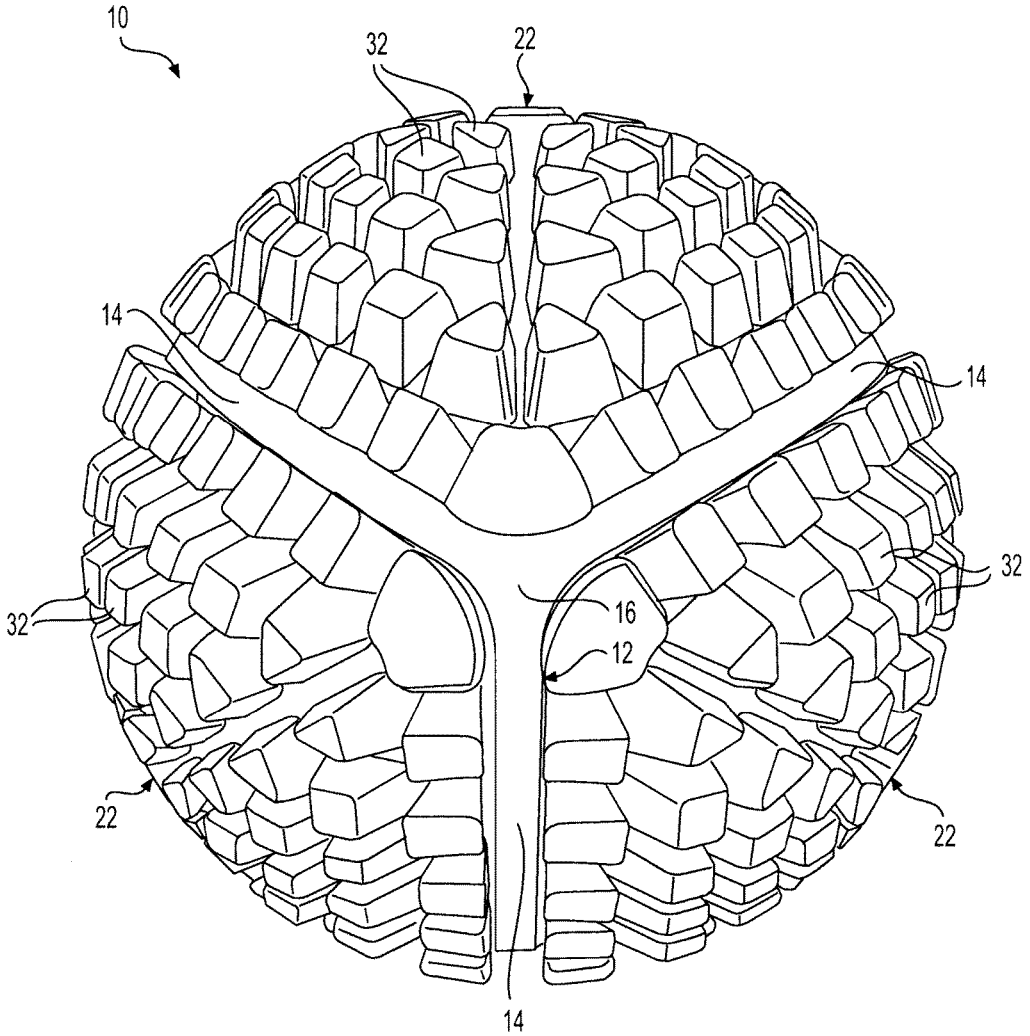
FIG. 3 is a back elevational view of the exercise ball device shown in FIG. 1.
Figure 4:
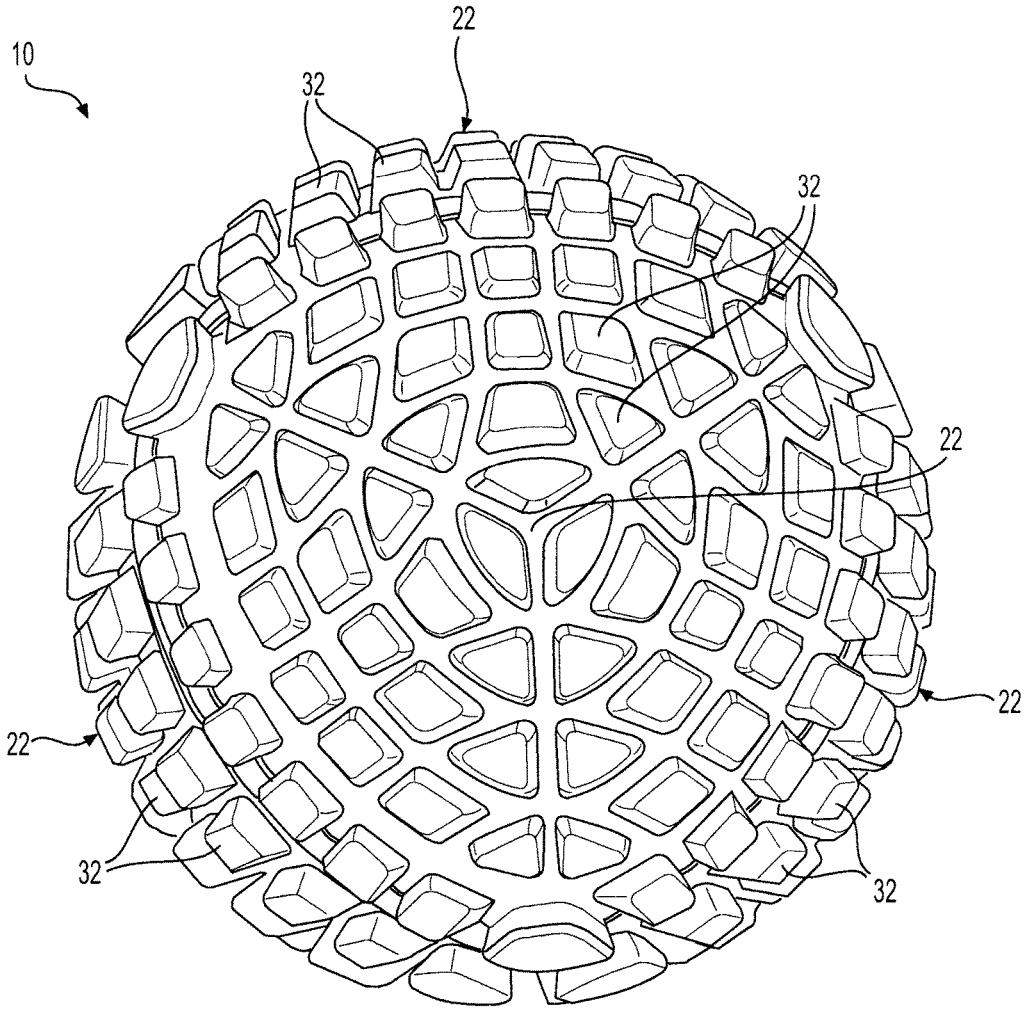
FIG. 4 is a top planar view of the exercise ball device shown in FIG. 1.
Figure 5:
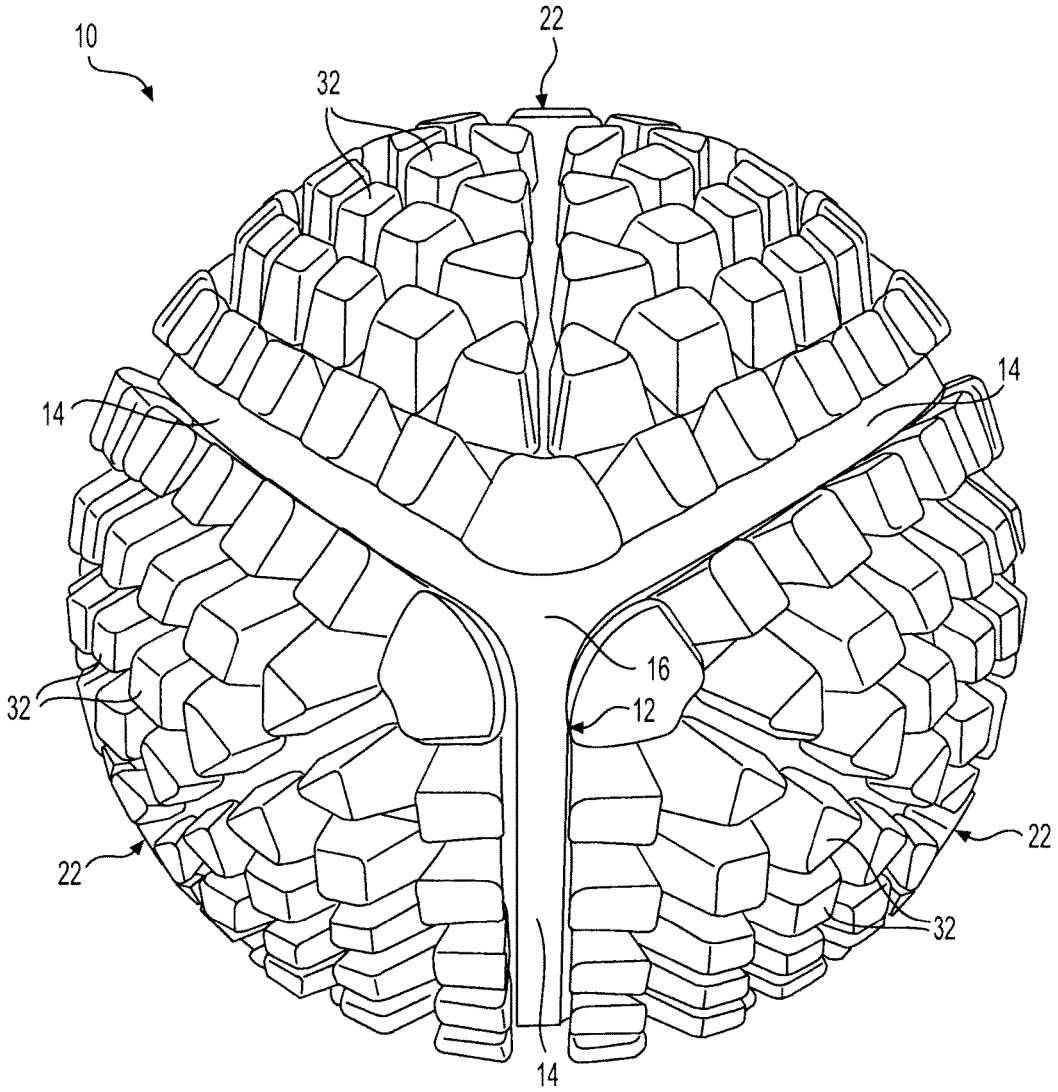
FIG. 5 is a bottom planar view of the exercise ball device shown in FIG. 1.
Figure 6:
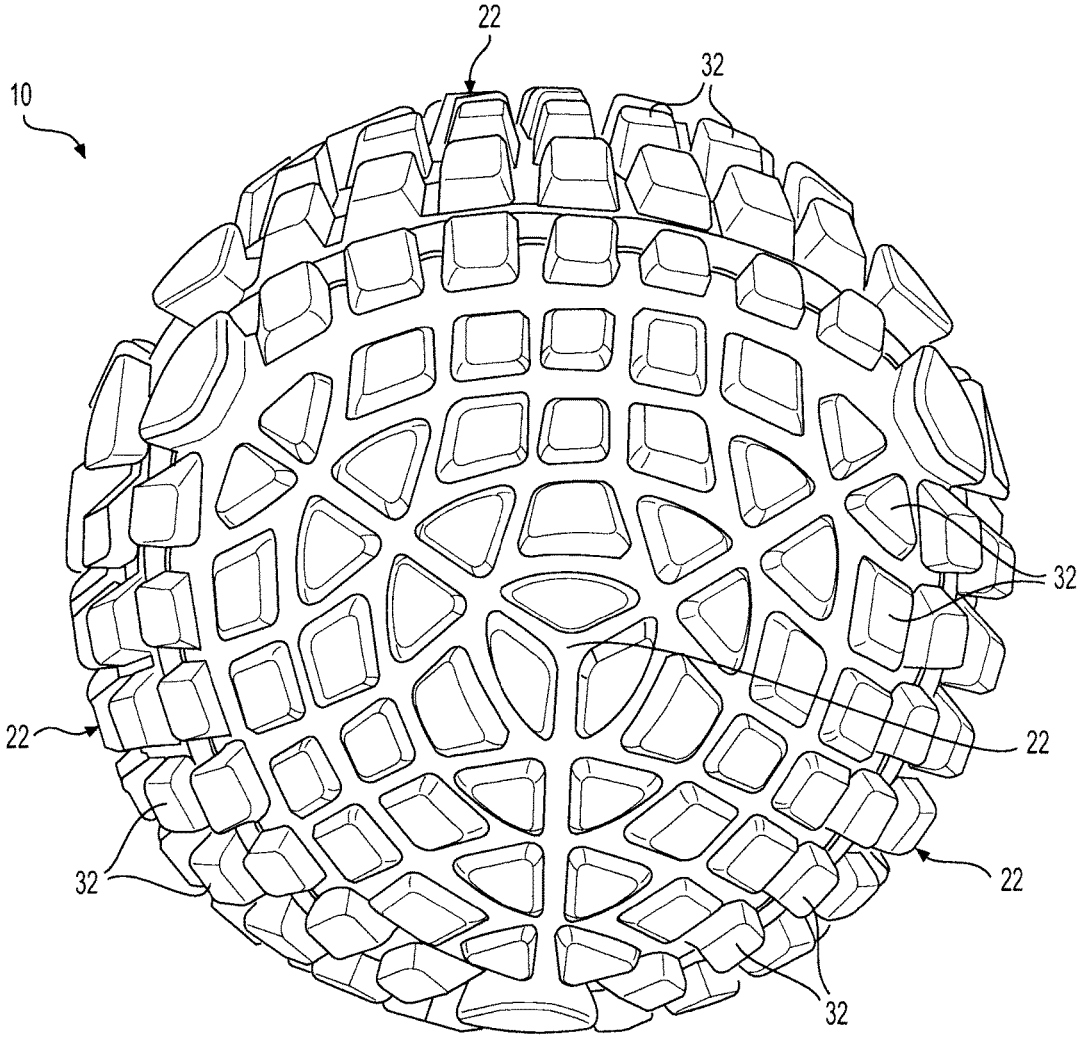
FIG. 6 is a left side elevational view of the exercise ball device shown in FIG. 1.
Figure 7:
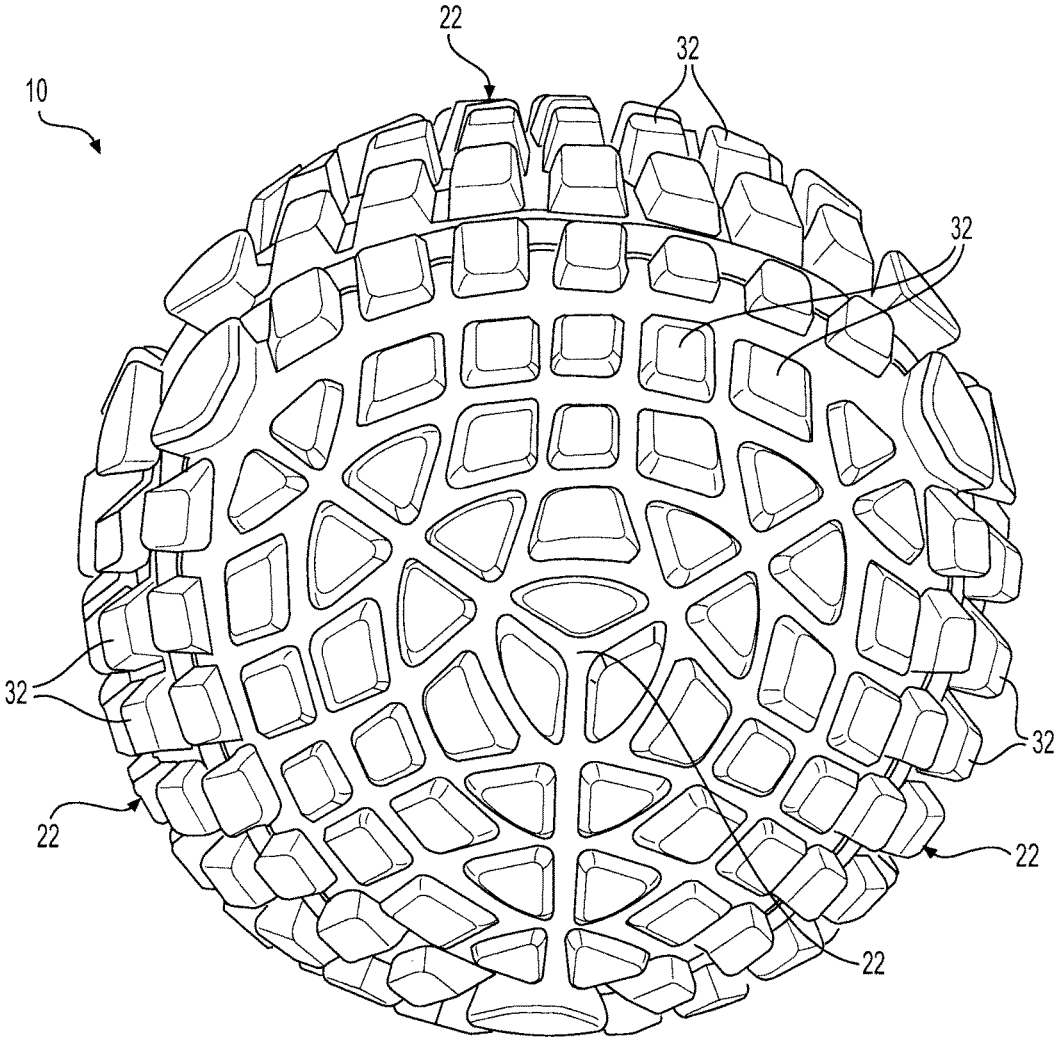
FIG. 7 is a right side elevational view of the exercise ball device shown in FIG. 1.

An exercise ball device 10 is shown in FIGS. 1 thru 13. The exercise ball device 10 comprises or consists of a frame 12 comprising multiple frame members 14 connecting together at multiple nodes (e.g. six (6) frame members 14 connected together at four (4) nodes 16).

A frame cross-member 18 connects together two (2) opposed frame members 14 to increase the rigidity and strength of the frame 12. The frame 12 can be a three (3) dimensional space frame that can be spherical-shaped like a ball. The frame 12 can be substantially rigid to rigid and made, for example, by forming (e.g. extruding, molding, injection molding), or machining a pre-form or block of material. The frame 12 can be made of plastic material (e.g. nylon, polyethylene, polypropylene, acrylonitrile butadiene styrene (ABS), or suitable plastic material, fiberglass, carbon fiber, boron fiber, Kevlar, or other suitable composite material). Alternatively, the frame can be made of metal (e.g. aluminum, titanium, metal composite), or made of multiple materials (e.g. metal frame overmolded with plastic material, frame constructed of metal and/or plastic parts.

The frame 12 can comprise six (6) frame members 14 connecting together at four (4) nodes defining four (4) openings 20 to into an interior (i.e. interior space) of the frame 12. The frame members 14 define and surround the openings 20, and support and accommodate the four (4) panels 22. The panels 22 can be the same size and shape. For example, each panel 14 can be approximately one-quarter of an outer surface layer of a sphere (i.e. four (4) quadrants). Further, the panels 22 are sized and shaped to fit into the openings 20 between the frame members 14 (i.e. the perimeter edges of the panels 22 dimensionally fit between the frame members 14 defining the openings 20).

Figure 8:
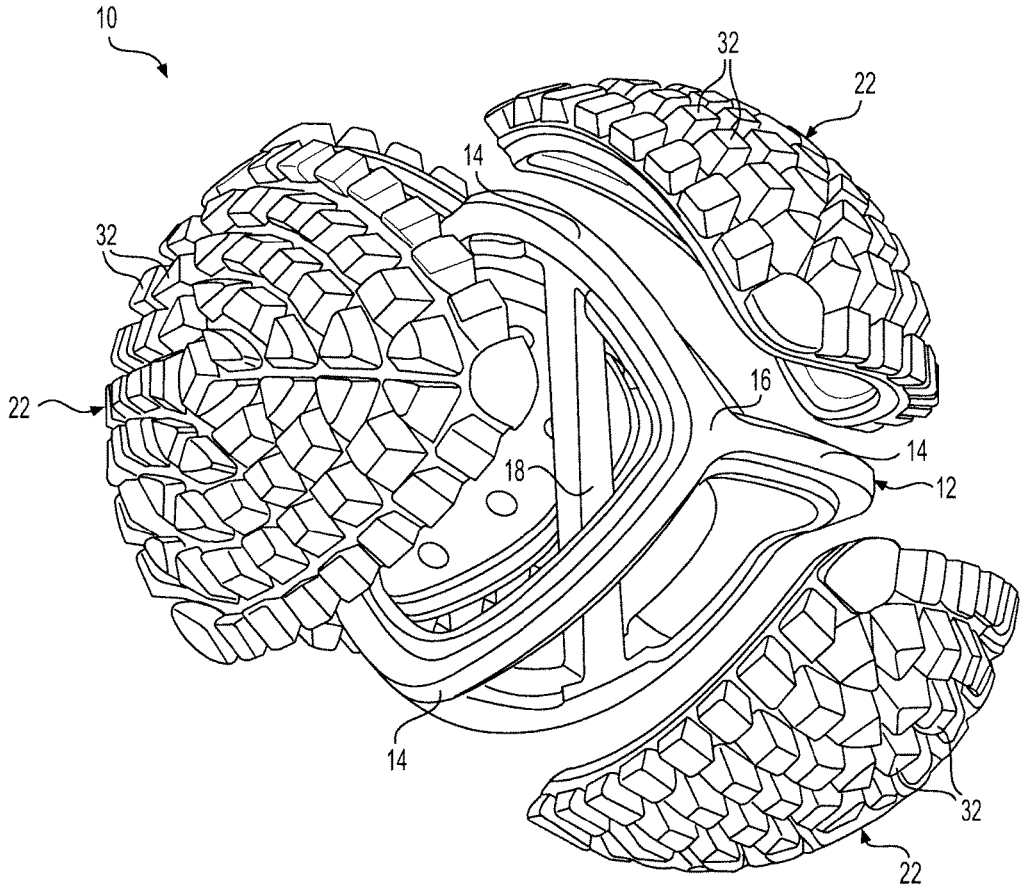
FIG. 8 is an exploded perspective view of the exercise ball device shown in FIG. 1.
Figure 9:
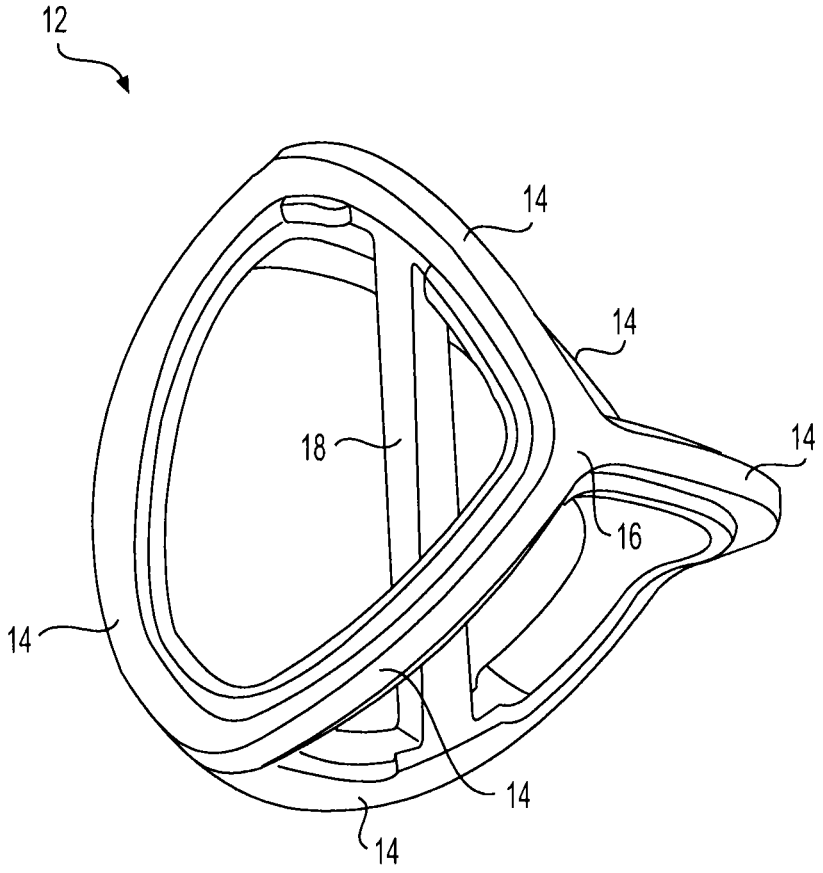
FIG. 9 is a perspective view of the frame of the exercise ball device shown in FIG. 8.

The frame 12 can comprise one or more flanges 24 provided around a perimeter of each of the openings 20 (e.g. continuous flange). Alternatively, the flanges 24 can be provided at portions or sections of each opening (e.g. discontinuous flange members or sections). As shown in FIG. 8, the flanges 24 are continuous, except for a portion or section of the frame adjacent the attachment points of the frame cross member 18 with the frame members 14. Further, the flanges 24 (e.g. side flanges 24) extend outwardly from the sides of the frame members 14. In addition the flanges 24 can be located below the outer surfaces of each frame members 14. This arrangement results in the panels 22 being at least partially located below the outer surface of the frame members 14 (i.e. the panels recessed below outer surface of frame members 14). For example, the base of the panels (i.e. the lower base or base layers) are recessed below or flush with the outer surfaces of the frame members while the spikes 32 extend above the outer surfaces of the frame members.

The exercise ball device 10, comprises a three-dimensional space frame comprising multiple frame members 14 defining multiple the openings 20 into the interior (i.e. interior space) of the frame 12. The multiple panels 22 connect to the frame members 12, and the panels 12 are disposed within the openings 20 and located between the frame members 12. The panels 22 can be recessed below an outer surface of the frame members 14, and the frame members 14 together with the panels 22 defining an outer surface of the exercise ball device 10. Alternatively, the height of the side flanges 26 on the frame members 14 can be adjusted (e.g. raise) so that the outer surface of the frame member 14 are flush with the outer surfaces of the panels 22.

Figure 12:
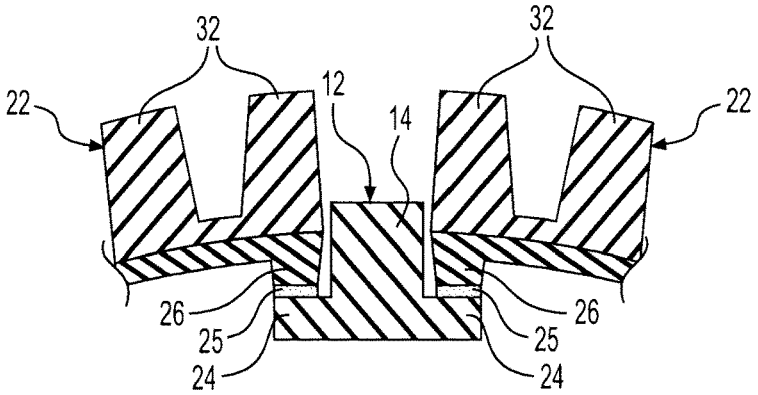
FIG. 12 is a partial detailed cross-sectional view through a frame member of the exercise ball device shown in FIG. 1.

The flanges 24 can cooperate with, connect to, and support the edges of the panels 22, in particular with the inner surface of the panels 22 located adjacent to the perimeter edges thereof. As shown in FIG. 12, two (2) adjacent panels 22 are connected to the frame 12, for example, by adhesive applied (e.g. adhesive layer 25) to the flanges 24, which adhesive bonds with the respective edges of the panels 22. Alternatively, the panels 22 can be heat welded, molded, overmolded, fastened, taped (e.g. double sided tape), or connected to the frame by other suitable devices and/or methods.

Figure 13:
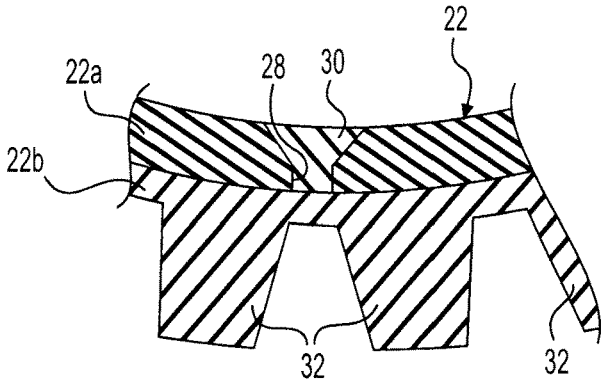
FIG. 13 is a partial detailed cross-sectional view through a panel of the exercise ball device shown in FIG. 1.

The construction of the panel 22 is shown in detail in FIGS. 10, 11, and 13. The panel 22 can comprise an inner support panel 22*a* connected to an outer cover panel 22*b*. For example, the inner support panel 22*a* can be molded, and the outer cover panel 22*b* can be overmolded onto the inner support panel 22*a*.

The inner support panel 22*a* comprises a flange 26 (i.e. raised or increased thickness portion) provided around a perimeter of the inner support panel 22*a*. The flange 26 of the inner support panel 22*a* can cooperate with and be connected (e.g. adhered) to the flange 24 of the frame 12. All four (4) panels 22 can be connected to the frame 22 in this manner to complete the construction or assembly.

The inner support panel 22*a* can be provided with multiple through holes 28, as shown in FIG. 11, for example, as seen on the cross-sectioned edge of the panel 22. The through holes 28 can be provided in a pattern (e.g. through holes 28 spaced apart by equal distances from each other in a geometrical pattern, matrix or grid).

As shown in FIG. 13, the through holes 28 can widen (e.g. by beveling, tapering, stepping) in a radial direction towards a center of the exercise ball device 10 (i.e. the through holes become wider in a direction from the outer surface towards the inner surface of the inner support panel 22*a*). This arrangement results in an anchoring head 30 being formed during molding inside the through hole 28 when the outer cover panel 22*b* is overmolded onto the inner support panel 22*a*.

The panels 22 can each be made by first injection molding the inner support panel 22*a*, for example, made of nylon material. Then each molded inner support panel 22*a* is overmolded (e.g. by insert molding) with the outer cover layer 22*b* made of soft plastic or thermoplastic elastomer material. This can result in the inner support panel 22*a* being bonded to the outer cover layer 22*b*. Further, the molded thermoplastic elastomer material when being molded flows and enters into the plurality of through holes 28 creating multiple anchors for mechanically fastening the outer cover layer 22*b* to the inner support layer 22*a*.

The outer cover layer 22*b* of the panels 22 can be textured (e.g. by molding). For example, a plurality of spikes 32 can be provided when molding the outer cover layer 22*b*. For example, the spikes 32 can protrude above the outer surfaces of the frame members, as shown in FIG. 12.

The exercise ball device 10 can be made by making the frame 12 (e.g. injection molding) and the panels 22 (e.g. injection molding), and then assembling these parts or components together. For example, the panels 22 can be connected or attached to the flanges 24 of the frame 12, for example, using adhesive material resulting in an adhesive layer 25 being located between each flange 24 and each panel 22. Specifically, the adhesive layer 25 is provided between the upper surface of each flange 24 and the lower surface adjacent the edge of each panel 22.

Optionally, the exercise ball device 10, for example, can be filled with a resilient material (e.g. shredded rubber) to add weight thereto.

In the exercise ball device 10 shown in FIGS. 1 thru 13, an outer surface of each frame member 14 is exposed when assembled. Further, as shown in FIG. 13, the outer surface of each frame member 14 is recessed (i.e. located below the height of the outer surface of the protrusions 32).

Further, the base or base layer of the panels 32 can be located below (i.e. recessed below) the outer surfaces of the frame members 14, as shown in FIG. 12, or alternatively, can be flush therewith.

Figure 14:
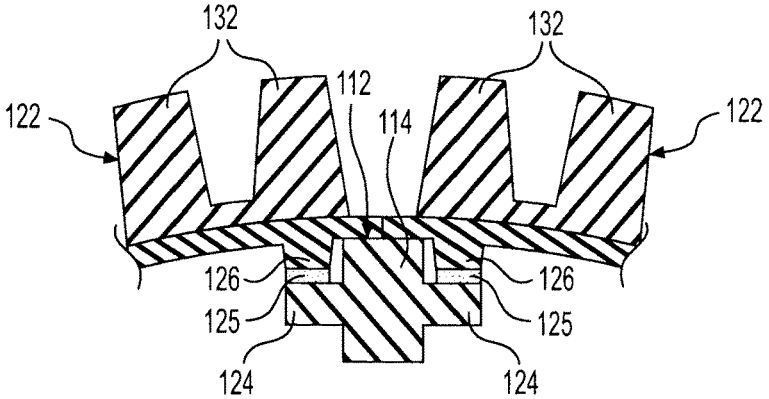
FIG. 14 is a partial detailed cross-sectional view through a frame member of another exercise ball device.

Another exercise ball device 110 is shown in FIG. 14. The panels 122 can be configured to abut each other and cover each frame member 122. For example, the flanges 124 can be raised on each frame member 114, and the panels 122 can be made to extend inwardly so as to cover each frame member 122 and abut each other. In this manner, the frame 112 is completely hidden under the panels 22 compared with the construction of the exercise ball shown in FIGS. 1 and 8.

USE

Figure 15:
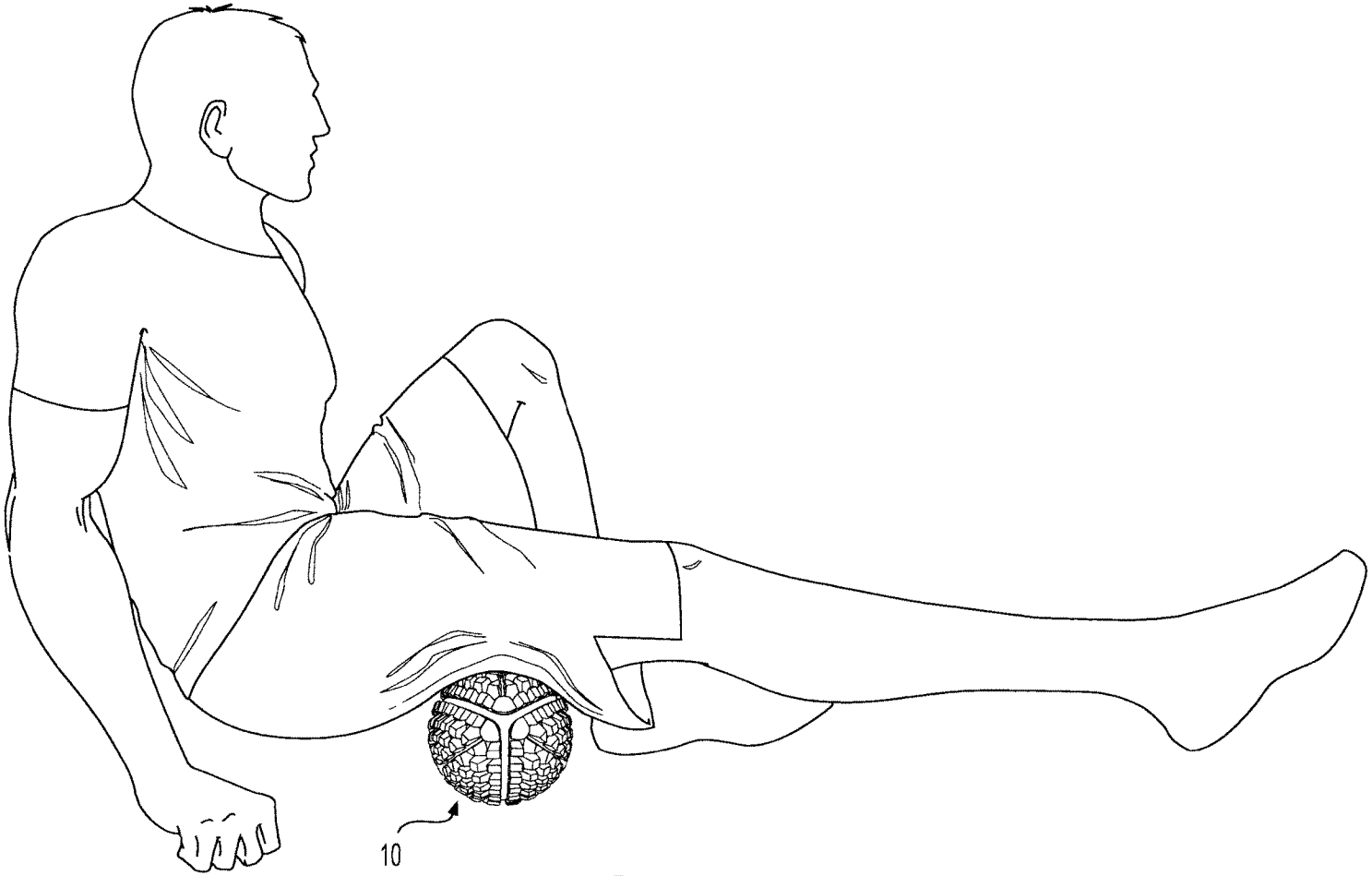
FIG. 15 is a diagrammatic side view of the exercise ball device shown in FIG. 1 located under the leg of the user.

The exercise ball device 10 can be can be positioned under the leg of a user, as shown in FIG. 15. The user can move his or her leg back and forth over the exercise ball device 10 to cause the exercise ball device 10 to roll on the ground while rolling on and manipulating the tissue (e.g. skin, muscle, bone, tendons, ligaments) of the user's leg.

Figure 16:
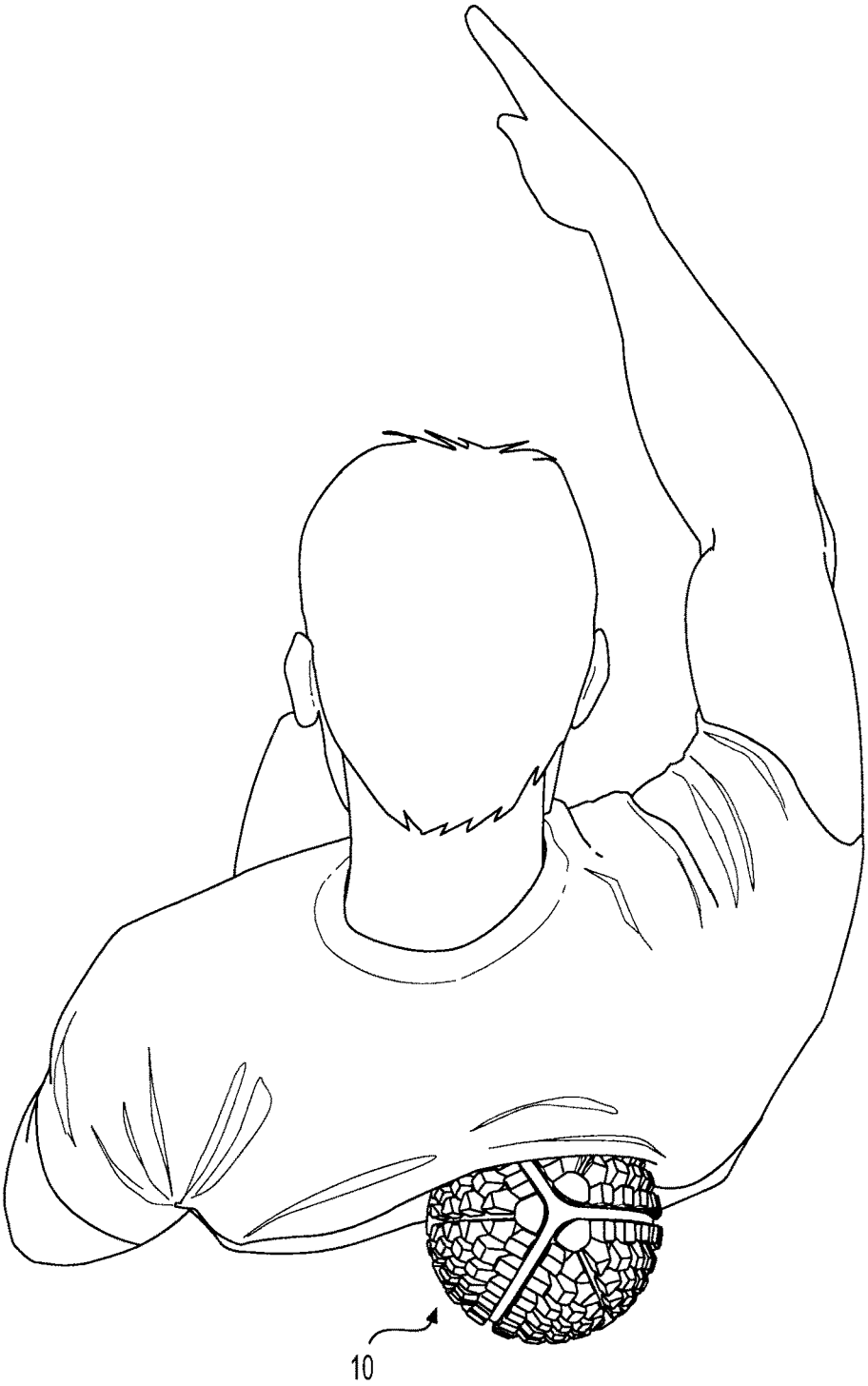
FIG. 16 is a diagrammatic rear view of the exercise ball device shown in FIG. 1 located under the right side of the user's back.

Alternatively, the user can position the exercise ball device 10 under the user's back, as shown in FIG. 16. The user can move his or her body back and forth over the exercise ball device 10 to cause the exercise ball device 10 to roll on the ground while manipulating the tissue of the user's back.

Figure 17:
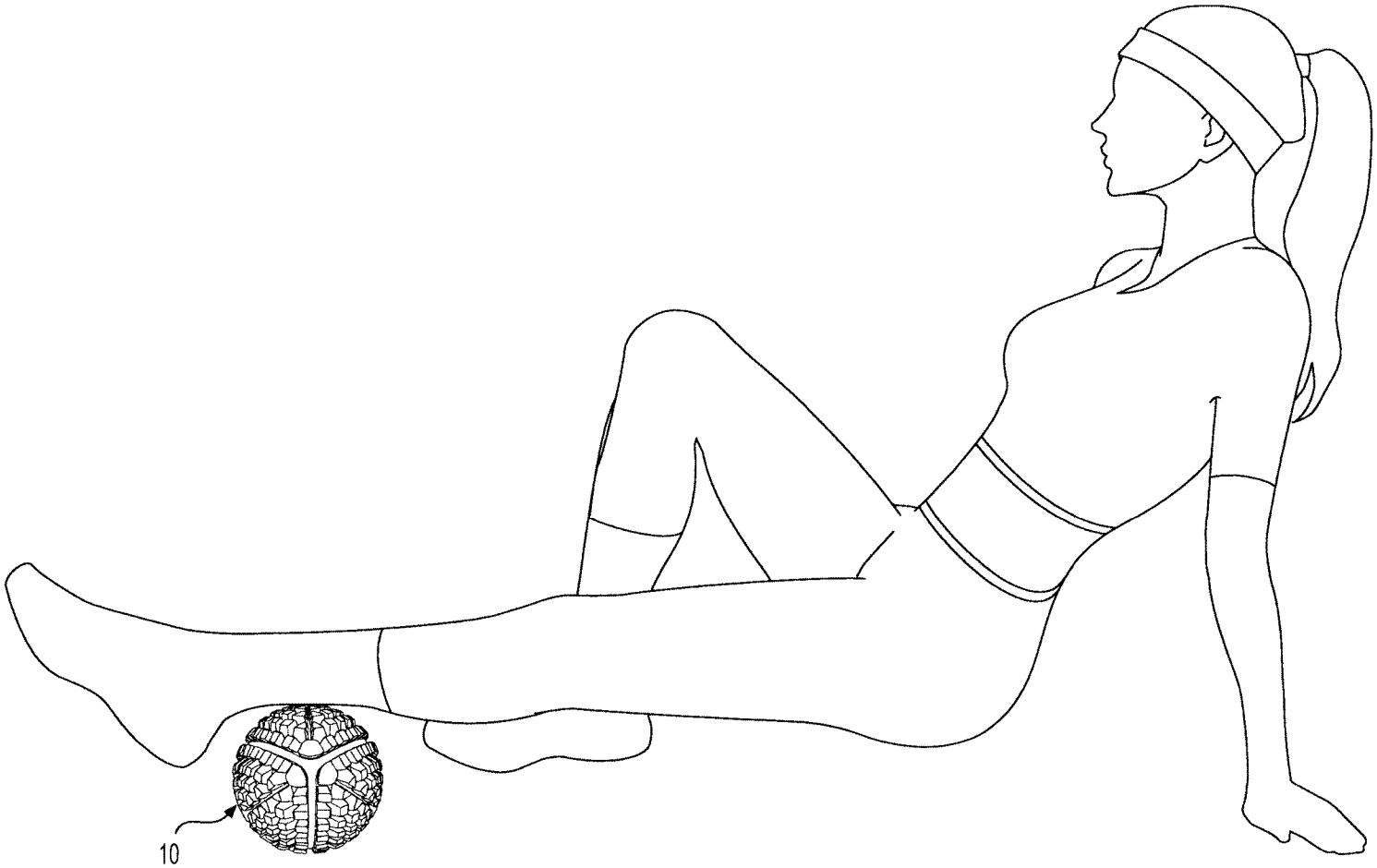
FIG. 17 is a diagrammatic side view of the exercise ball device shown in FIG. 1 located under the left ankle of the user.
Figure 18:
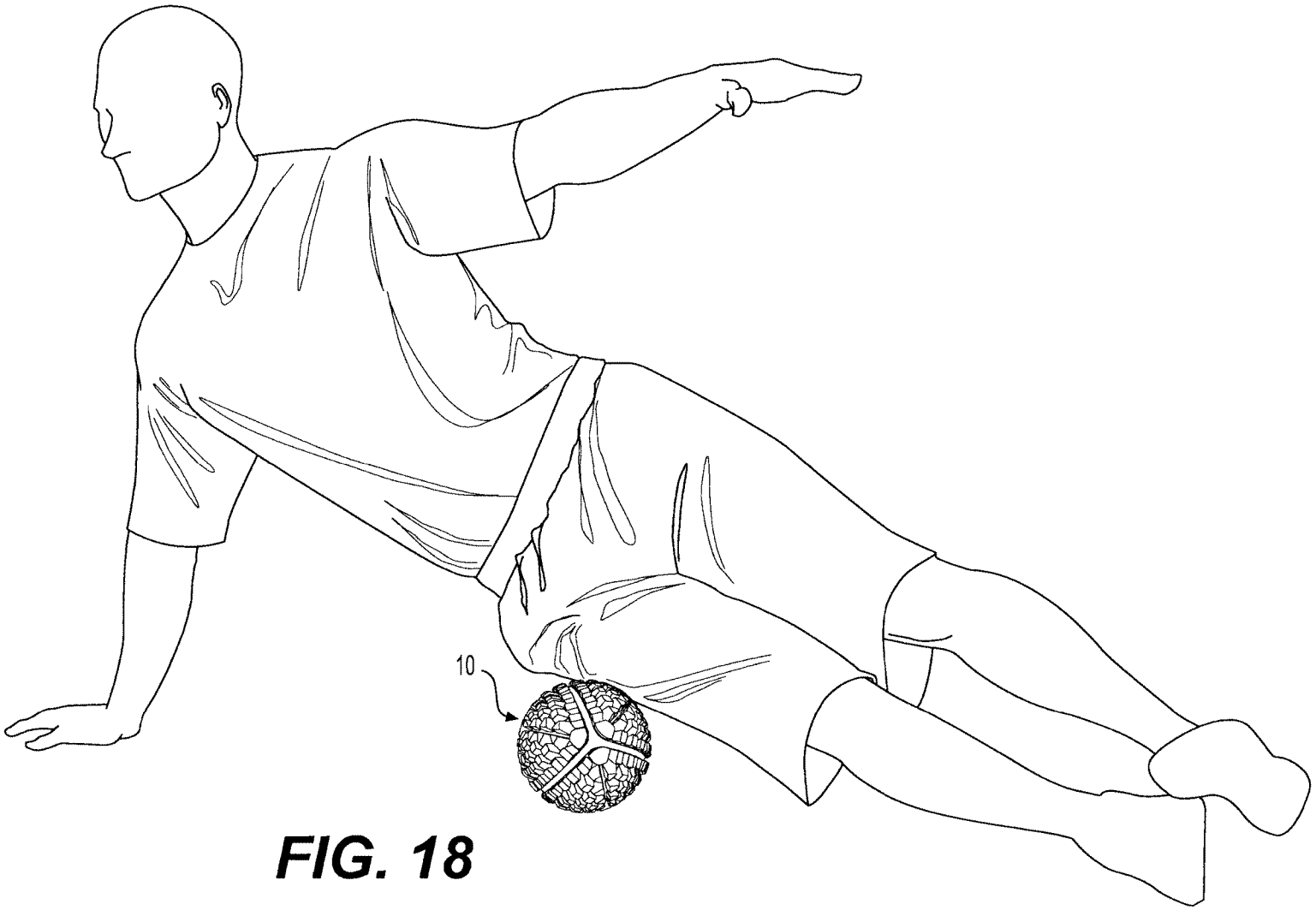
FIG. 18 is a diagrammatic side view of the exercise ball device shown in FIG. 1 under the right thigh of the user.

As a further alternative, the user can position the exercise ball device 10 under the user's thigh, as shown in FIG. 17. The user can move his or her leg back and forth over the exercise ball device 10 to cause the exercise ball device 10 to roll on the ground while manipulating the tissue of the user's thigh.

I claim:

1. An exercise ball device, comprising:

a single piece rigid spherical-shaped three-dimensional space frame configured to define multiple openings into an interior of the frame; and multiple resiliently deformable panels connected to the frame, the panels openings, wherein each panel comprises a resilient outer cover panel joined to an inner support panel, the inner support panel being stiffer than the resilient outer cover panel.

2. The device according to claim 1, wherein the openings are of the same size and shape.

3. The device according to claim 2, wherein the panels are each shaped as one-half of a sphere.

4. The device according to claim 2, wherein the panels are each shaped as one-third of a sphere.

5. The device according to claim 2, wherein the panels are each shaped as one-fourth of a sphere or quadrants of a sphere.

6. The device according to claim 1, wherein the panels are each shaped as portions of a sphere.

7. The device according to claim 6, wherein the panels are of the same size and shape.

8. The device according to claim 1, wherein a perimeter of each panel fits into each opening in the frame.

9. The device according to claim 1, wherein the exercise device is a resiliently deformable exercise device.

10. The device according to claim 9, wherein the frame is made of plastic material.

11. The device according to claim 1, wherein a base of each of the panels is recessed below or flush with an outer surface of the frame.

12. The device according to claim 11, wherein each panel comprises spikes, and the spikes protrude above the outer surface of the frame.

13. The device according to claim 1, wherein the frame comprises one or more flanges configured to connect to outer edges of the panels.

14. The device according to claim 13, wherein the one or more flanges are provided at a perimeter edge of each opening cooperating with the outer edges of each panel.

15. The device according to claim 14, wherein the one or more flanges are located below an outer surface of the frame.

16. The device according to claim 1, wherein the inner support panel comprises a plurality of through holes and the resilient outer cover panel is overmolded onto the inner support panel so that hot plastic material flows and enters the through holes, and then hardens to form a plurality of mechanical anchors for joining the resilient outer cover panel and inner support panel together.

17. The device according to claim 16, wherein inner ends of the through holes are beveled or chamfered to provide a greater retaining or anchoring strength.

18. An exercise ball device, comprising:

a rigid single piece spherical-shaped three-dimensional space frame comprising multiple frame members connected together at multiple nodes and configured to define multiple equally sized and shaped openings into an interior of the frame, the frame members comprising one or more flanges located below an outer surface of the frame members; and multiple equally shaped and sized resiliently deformable panels connected to the one or more flanges and covering respective openings in the frame and defining an outer surface of the exercise ball device, wherein each panel comprises a resilient outer cover panel joined to an inner support panel, the inner support panel being stiffer than the resilient outer cover panel.

19. An exercise ball device, comprising:

a rigid single piece spherical-shaped three-dimensional space frame comprising multiple frame members connected together at multiple nodes and configured to define multiple openings into an interior of the frame, the frame members comprising one or more flanges located below an outer surface of the frame members; and multiple resiliently deformable panels connected to the one or more flanges and covering respective openings in the frame, the multiple panels each comprising a resilient outer cover panel joined to an inner support panel, the inner support panel being stiffer than the resilient outer cover panel.

* * * * *